United States Patent [19]

McConaghy, Jr. et al.

[11] Patent Number: 4,604,185

[45] Date of Patent: Aug. 5, 1986

[54] CO-PROCESSING OF STRAIGHT RUN VACUUM RESID AND CRACKED RESIDUA

[75] Inventors: James R. McConaghy, Jr.; Ardis L. Anderson, both of Ponca City, Okla.

[73] Assignee: Conoco Inc., Ponca City, Okla.

[21] Appl. No.: 750,968

[22] Filed: Jul. 2, 1985

[51] Int. Cl.[4] ..... C10G 47/32

[52] U.S. Cl. ..... 208/56; 208/100

[58] Field of Search ..... 208/56, 68, 93, 100, 208/102, 104

[56] References Cited

U.S. PATENT DOCUMENTS

| | | | |
|---|---|---|---|
| 2,843,529 | 7/1958 | Hill et al. | 208/56 |
| 2,873,245 | 2/1959 | Thompson et al. | 208/56 X |
| 2,953,513 | 9/1960 | Langer, Jr. | 208/56 |
| 3,594,309 | 7/1971 | Stolfa | 208/100 X |
| 3,928,173 | 12/1975 | James | 208/100 X |
| 4,002,556 | 1/1977 | Satchell, Jr. | 208/56 X |
| 4,115,246 | 9/1978 | Sweany | 208/56 |
| 4,178,229 | 12/1979 | McConaghy et al. | 208/56 X |

*Primary Examiner*—Andrew H. Metz
*Assistant Examiner*—Glenn A. Caldarola
*Attorney, Agent, or Firm*—Richard W. Collins

[57] ABSTRACT

Vacuum resid and cracked residuum such as decant oil or thermal tar are processed together to reduce the ultimate yield of coke, asphalt and fuel oil. The vacuum resid is donor cracked, and the donor cracker effluent is quenched with decant oil or thermal tar and then fractionated. Fractionator bottoms are vacuum distilled, and vacuum tower overheads are hydrogenated to produce donor for the donor cracker.

4 Claims, 1 Drawing Figure

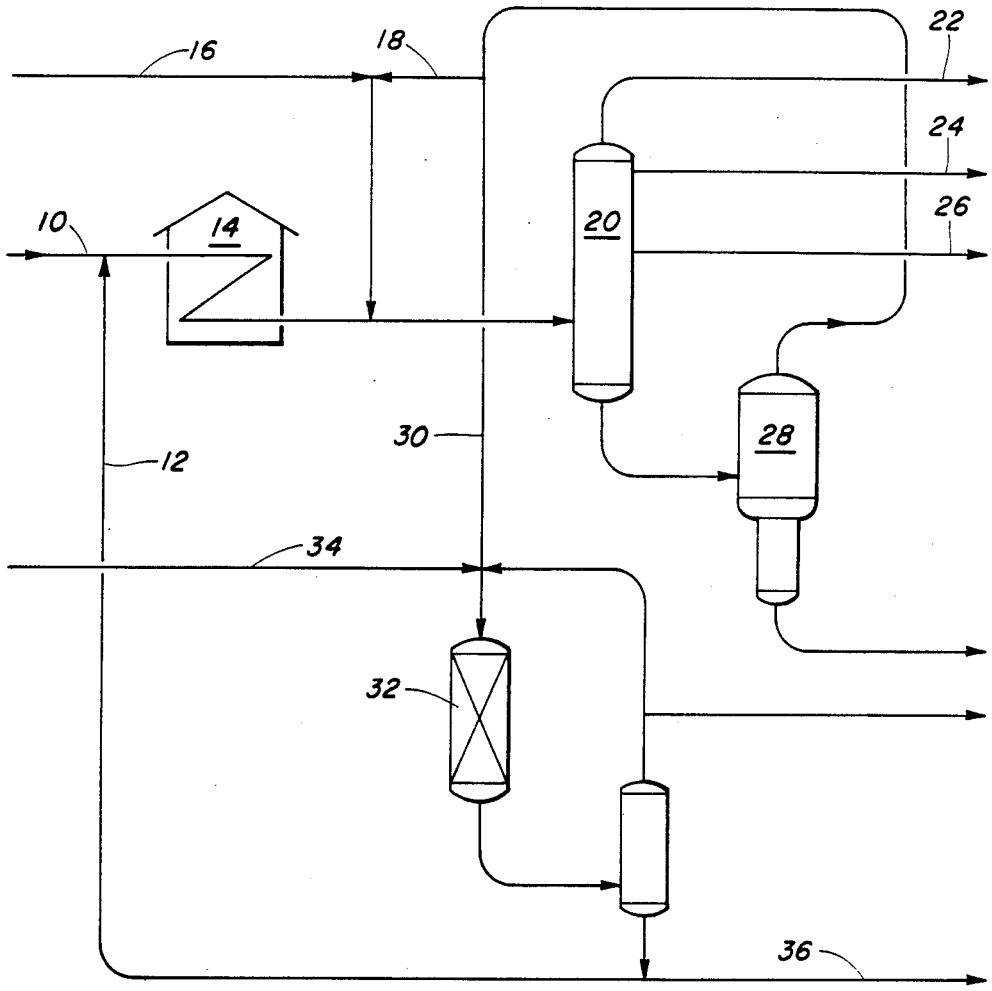
16
18
22
24
26
10
14
20
28
30
12
34
32
36

CO-PROCESSING OF STRAIGHT RUN VACUUM RESID AND CRACKED RESIDUA

BACKGROUND OF THE INVENTION

1. Field of the Invention

This invention relates to upgrading of hydrocarbon residuum streams, and more particularly to a process for simultaneously processing straight run vacuum resid with a cracked residuum.

Upgrading of hydrocarbon residua is a processing problem in both conventional petroleum refining operations and tar sand bitumen processing plants. The problems associated with residua processing are particularly acute in those refineries where geographic location does not permit sale of coke or fuel oil. Asphalt production often encounters severe market limitations that are aggravated by seasonal variation.

Although straight run vacuum resids are often considered the primary residuum that must be considered for upgrading or disposal, cracked residual stocks produced in conventional refining processes must also be included in the overall refinery economics. Such cracked residual stocks include FCC residues (decant oil, clarified oil, slurry oil), thermal tars, pyrolysis tars and other similar materials. As used herein, the term "resid" is intended to mean straight run vacuum tower bottoms, while cracked residual stocks are referred to collectively as cracked residua, or cracked residuum in the case of a single cracked material.

Cracked residua present a unique problem. They are highly aromatic, often contain suspended solids and usually are higher in sulfur than virgin stocks of the same boiling range. The aromaticity precludes their processing in zeolite catalyzed cracker units. The suspended particulates (catalyst fines or coke particles) present in these materials make direct catalytic hydroprocessing impractical due to catalyst deactivation and bed plugging problems. The relatively high sulfur content of most of these streams make direct sale as fuel impossible due to environmental constraints.

The process of this invention employs a variation of hydrogen donor diluent cracking to both reduce the quantity of residual material that must be disposed of as fuel and/or asphalt and to convert the cracked residua into an upgraded FCC feed or a low sulfur distillate fuel. The inherent aromaticity of cracked residua is used to advantage.

2. The Prior Art

The most pertinent prior art is believed to be U.S. Pat. No. 2,953,513 to Langer. The Langer patent describes the basic hydrogen donor diluent cracking (HDDC) process, and includes a detailed description of applicable operating conditions. The Langer patent further describes one and two stage HDDC operations utilizing vacuum distillation of the donor cracked material.

The Langer patent, however, does not suggest co-processing of straight run vacuum resid with a cracked residuum, and does not describe a process in which a cracked residuum such as decant oil from an FCC unit can be utilized as part of the donor diluent without subjecting the hydrogenation catalyst to contamination from solids entrained in the decant oil. In the process of the invention, cracked residua can be co-processed with straight run vacuum resids without subjecting the hydrogenation catalyst to contamination from solids in the cracked residua.

SUMMARY OF THE INVENTION

According to this invention, a variation of the HDDC process is utilized to reduce the quantity of residual material that must be disposed of as fuel or asphalt and to convert cracked residua into an upgraded FCC feed or a low sulfur distillate fuel.

The process of this invention dramatically reduces the overall quantity of hydrocarbons that must be utilized as low value products such as asphalt, fuel oil or fuel coke.

BRIEF DESCRIPTION OF THE DRAWING

The FIGURE is a schematic flowsheet illustrating the process of the invention.

DESCRIPTION OF THE PREFERRED EMBODIMENT

As shown in the drawing, straight run vacuum resid from line 10 is combined with hydrogen donor diluent from line 12 and charged to cracking furnace 14 where the resid is cracked to lighter liquids and gases. The cracking furnace operating conditions do not constitute a novel feature of the process, and may be any suitable conditions at which at least 60 volume percent of the 1000° F.+ material is converted to material boiling below 1000° F. Typically, a furnace pressure of 200 to 1000 psig and a furnace outlet temperature of from 900° to 1000° F. will provide the desired result. A cracked residuum from line 16, such as decant oil in an amount of from 3 to 100 volume percent of the straight run vacuum resid and containing a high percentage of aromatic components, is combined with vacuum gas oil from line 18 and used to quench the cracked effluent from cracking furnace 14. The amount of combined cracked residuum and vacuum gas oil used is sufficient to cool the furnace effluent to 800° F. or lower.

The combined reactor effluent and quench liquid is charged to fractionator 20 where various product streams are recovered from lines 22, 24 and 26, and a fractionator bottoms stream is charged to vacuum distillation unit 28 and separated into vacuum gas oil and residual material. The vacuum gas oil contains aromatic components from the cracked residuum, and is partially used as quench material for the furnace effluent and partially passed via line 30 to hydrogenation reactor 32 where it is combined with hydrogen from line 34 and partially hydrogenated in a known manner to produce hydrogen donor diluent for use in cracking furnace 14. A portion of the partially hydrogenated diluent may be recovered from line 36 as a hydrogenated gas oil product of reduced sulfur content.

To illustrate a specific preferred embodiment of the invention, the following example is described with reference to the drawing.

EXAMPLE I

In this example, ten thousand barrels per day of straight run vacuum resid is charged via line 10 to cracking furnace 14. The vacuum resid is mixed with an equal volume of partially hydrogenated donor diluent from line 12 prior to entering the cracking furnace. The furnace 14 is operated at a pressure of 500 psig and an outlet temperature of 950° F. such that 80 volume percent of the 1000° F.+ fraction of the feed is converted to products boiling below 1000° F. The furnace effluent is quenched to 800° F. with a stream comprised of 800 barrels per day of fluid cat cracker decant oil from line 16 combined with sufficient vacuum gas oil from line 18 to achieve the 800° F. quench temperature. The quenching step, as is known, prevents coke formation at the furnace outlet.

The quenched stream is then reduced in pressure, cooled by heat exchange to 650° F., and charged to fractionator 20 to remove gas and liquid product streams.

The bottoms stream from the fractionator is charged to vacuum tower 28 where it is separated into a vacuum gas oil fraction (nominal boiling range 650°-1000° F.) and a 1000° F.+ fraction. The 1000° F.+ fraction may be used as fuel oil, coal spray oil, coker feed or asphalt base. The volume of 1000° F.+ material is not more than the sum of 20 volume percent of the 1000° F.+ material in the straight run vacuum resid charge and the 1000° F.+ fraction of the decant oil.

The vacuum tower also serves the function of separating particulate solids in the decant oil, such that the solids are concentrated in the vacuum tower bottoms stream. The vacuum gas oil is an essentially solids-free stream which when catalytically hydrotreated to make donor diluent does not present catalyst bed plugging problems.

The vacuum gas oil is condensed, and if necessary to provide adequate quenching of furnace effluent a minor fraction is used for that purpose. The major portion of the vacuum gas oil is mixed with a hydrogen-rich gas stream from line 34 and catalytically hydrogenated in reactor 32 over a conventional nickel-molybdenum on alumina catalyst at 675° F. and 750 psig and a liquid hourly space velocity of 2. Suitable hydrogenation conditions, as is known, are chosen so that at least one ring in the multiring aromatic molecules remains unsaturated.

The addition of cracked residuum such as decant oil enhances the potential hydrogen donor effectiveness of the vacuum gas oil stream by contributing a higher proportion of multiring aromatic molecules than would be available from the straight run vacuum resid alone.

A major fraction of the hydrogenated gas oil is recycled as hydrogen donor diluent to be mixed with the fresh straight run vacuum resid feed and charged to the cracking furnace. A minor fraction of the hydrogenated gas oil is used as fluid catalytic cracker feed and partially converted to gasoline. Alternatively, this gas oil may be utilized as a low sulfur fuel oil. The sulfur level of this gas oil stream is less than would be expected from the hydrogenation conditions in reactor 32 as a result of recycling of the gas oil stream which results in an effective space velocity in the hydrogenation reactor which is much lower than the single pass velocity.

The process described herein dramatically reduces the overall quantity of traditionally low value products such as asphalt, fuel coke or residual fuel oil which are normally obtained from straight run vacuum resid. Dissimilar streams such as straight run vacuum resid and cracked residua may be processed simultaneously, with a major portion of the product streams being upgraded in quality.

The essential features of the process are that straight run vacuum resid is donor cracked, with an aromatic cracked residuum being combined with the cracked effluent and separated into product streams and a bottoms stream which is charged to a vacuum tower where clean gas oil for hydrogenation and use as donor diluent is produced.

The foregoing detailed description and example are intended to be illustrative rather than limiting, and numerous variations and modifications within the scope of the invention will be apparent.

We claim:

1. A process for simultaneously processing straight run vacuum resid and cracked residuum to produce distilled products and a 1,000° F.+ fraction in an amount of not more than the sum of 40 volume percent of the 1,000° F.+ material in the straight run vacuum resid and the 1,000° F.+ fraction of the cracked residuum, said process comprising:

(a) combining a partially hydrogenated donor diluent solvent with said vacuum resid;

(b) subjecting said combined vacuum resid and solvent to hydrogen donor diluent cracking under conditions at which at least 60 volume percent of the fraction of said resid boiling above 1,000° F. is converted to material boiling below 1,000° F.;

(c) combining the effluent from said donor diluent cracking step with quench material selected from the group consisting of cracked residuum, vacuum gas oil and mixtures thereof in an amount sufficient to substantially prevent coke formation at the donor diluent cracking furnace outlet;

(d) combining with said effluent from said donor diluent cracking step a cracked residuum in an amount of from 3 to 100 volume percent of said straight run vacuum resid; a part or all of which cracked residuum may have been utilized as the quench material in step (c);

(e) subjecting said effluent cracked residuum, quench material and cracked residuum to fractionation to produce distilled products and a fractionator bottoms stream;

(f) subjecting said fractionator bottoms stream to vacuum distillation to produce a residual product and a vacuum gas oil stream comprised in part of the aromatic components of said cracked residuum;

(g) subjecting at least a part of said vacuum gas oil stream to a catalytic hydrogenation step to produce a partially hydrogenated hydrogen donor diluent product;

(h) utilizing at least a part of said partially hydrogenated hydrogen donor diluent product as the solvent in step (a); and (i) recovering distilled product streams and a 1,000° F.+ product stream in an amount of not more than the sum of 40 volume percent of the 1,000° F.+ material in said straight run vacuum resid and the 1,000° F.+ fraction of the cracked residuum.

2. The process of claim 1 wherein said cracked residuum is selected from the group consisting of FCC residues, thermal tars and pyrolysis tars.

3. The process of claim 1 wherein said cracked residuum is decant oil.

4. The process of claim 1 wherein the amount of said 1,000° F.+ product stream is not more than the sum of 20 volume percent of the 1,000° F.+ material in said straight run vacuum resid and the 1,000° F.+ fraction of the cracked residuum.

* * * * *